US008827833B2

(12) United States Patent
Amano et al.

(10) Patent No.: US 8,827,833 B2
(45) Date of Patent: Sep. 9, 2014

(54) GOLF CLUB HEAD

(71) Applicant: K.K. Endo Seisakusho, Tsubame (JP)

(72) Inventors: Junichi Amano, Tsubame (JP); Toru Tamaki, Tsubame (JP)

(73) Assignee: K.K. Endo Seisakusho, Niigata (JP)

( * ) Notice: Subject to any disclaimer, the term of this patent is extended or adjusted under 35 U.S.C. 154(b) by 15 days.

(21) Appl. No.: 13/773,107

(22) Filed: Feb. 21, 2013

(65) Prior Publication Data

US 2013/0217513 A1 Aug. 22, 2013

(30) Foreign Application Priority Data

Feb. 22, 2012 (JP) ..... 2012-036490

(51) Int. Cl.
*A63B 53/04* (2006.01)
*B41M 5/24* (2006.01)

(52) U.S. Cl.
CPC *A63B 53/04* (2013.01); *B41M 5/24* (2013.01); *A63B 2053/0445* (2013.01); *A63B 2225/60* (2013.01)
USPC ..... 473/331; 473/330

(58) Field of Classification Search
USPC ..... 473/331, 330, 329
See application file for complete search history.

(56) References Cited

U.S. PATENT DOCUMENTS

| | | | | |
|---|---|---|---|---|
| 7,927,230 | B2 * | 4/2011 | Solheim | 473/329 |
| 8,287,401 | B2 * | 10/2012 | Tateno et al. | 473/331 |
| 8,449,406 | B1 * | 5/2013 | Frame et al. | 473/329 |
| 2009/0325728 | A1 * | 12/2009 | Solheim et al. | 473/331 |
| 2011/0151998 | A1 * | 6/2011 | Ban | 473/331 |
| 2011/0269568 | A1 | 11/2011 | Ban | |
| 2012/0264537 | A1 * | 10/2012 | Breier et al. | 473/331 |

FOREIGN PATENT DOCUMENTS

JP 2011-234748 A 11/2011

* cited by examiner

*Primary Examiner* — Benjamin Layno
(74) *Attorney, Agent, or Firm* — Troutman Sanders LLP

(57) ABSTRACT

There is provided a golf club head capable of reliably preventing a backspin rate from varying in rainfall. A plurality of fine grooves are formed on a face surface 2. When observing a cross-sectional surface perpendicular to the face surface 2 involving a vertical line passing through the center G of gravity of the golf club head 1 with the golf club head 1 set at preset loft and lie angles, an average width of the fine grooves 4 in the cross-sectional surface is 100 μm or less and an average pitch thereof in the cross-sectional surface is 100 μm or less. Hence, the discharge of water can be accelerated by a capillary phenomenon, making it possible to reliably prevent a backspin rate of a golf ball from varying in rainfall.

18 Claims, 8 Drawing Sheets

GOLF CLUB HEAD

CROSS-REFERENCE TO RELATED APPLICATIONS

This application claims the benefit of priority to Japanese Patent Application No. 2012-036490, filed on Feb. 22, 2012, the entire contents of which are incorporated herein by reference.

BACKGROUND OF THE INVENTION

1. Field of the invention

The present invention relates to a golf club head.

2. Description of the Related Art

When hitting a golf ball by a golf club, a backspin is put on the golf ball. A backspin rate exerts a great impact on a carry and trajectory of the golf ball, and hence is desired to be as constant as possible regardless of hitting conditions of the golf ball. This is because if a backspin rate of the golf ball is kept constant regardless of the hitting conditions, it becomes possible for the golf ball to be invariably hit to a target place.

There has been a problem, however, that when a face surface of the golf club head, acting as a contact surface with respect to the golf ball, gets wet due to rainfall or the like, the backspin rate varies significantly. Such variation in backspin rate increases under a wet condition compared to under a dry condition in the case of a driver, but conversely in the case of a wedge it decreases significantly under a wet condition.

Whereas, a plurality of grooves, called score lines, are generally formed on the face surface of the golf club head in a toe-to-heel direction for the sake of stabilizing the backspin rate. The configuration or the like of the score lines, however, is strictly regulated by the rules and therefore there is a limit to suppressing the variations of the backspin rate in rainfall by devising the configuration of the score lines.

In order to solve such problem, it has been proposed to form fine grooves with a width of 200 to 800 μm on a face surface, as disclosed in Japanese unexamined patent application publication No. 2011-234748. As such, it has conventionally been believed that wider grooves formed on the face surface exert a higher water discharging effect than do thinner grooves thereon. It has been learnt by an experiment, however, that even if such comparatively wide fine grooves are formed on the face surface, there cannot be obtained a sufficient effect to prevent the backspin rate from varying in rainfall.

SUMMARY OF THE INVENTION

Therefore, with a view to the above problem, it is an object of the present invention to provide a golf club head capable of reliably preventing a backspin rate of a golf ball from varying in rainfall.

According to a first aspect of the present invention, there is provided a golf club head including: a plurality of fine grooves formed on a face surface thereof, the fine grooves having an average width of 100 μm or less in a cross-sectional surface perpendicular to the face surface and an average pitch of 100 μm or less in the cross-sectional surface, when the cross-sectional surface perpendicular to the face surface involving a vertical line passing through the center of gravity of the golf club head is observed, with the golf club head set at preset loft and lie angles.

According to a second aspect of the present invention, there is provided the golf club head in which the average width of the fine grooves in the cross-sectional surface is 50 μm or less and the average pitch of the fine grooves in the cross-sectional surface is 50 μm or less.

According to a third aspect of the present invention, the fine grooves are formed at least in the vicinity of a point of intersection between a vertical line dropped from the center of gravity of the golf club head to the face surface and the face surface.

According to a fourth aspect of the present invention, the face surface includes a plurality of score lines, and satisfies the following relationships:

$$n > L/100\ (\mu m),$$

$$0.3(P-H) < L,$$

$$0 < d < 30\ (\mu m),\ \text{and}$$

$$2 < Ra < 5\ (\mu m)$$

wherein, in the cross-sectional surface, n denotes the number of protrusions formed by the fine grooves, L denotes a distance between the protrusions located at both the farthermost ends in an approximately flat portion between adjacent score lines of the score lines, P denotes a distance between centers of the adjacent score lines, H denotes a score line width measured by the 30 degree method of measurement, d denotes an average value of level differences between depressions and the protrusions which are formed by the fine grooves, and Ra denotes surface roughness in a region formed with the fine grooves.

According to a fifth aspect of the present invention, the fine grooves are formed by processes involving a laser process.

According to a sixth aspect of the present invention, the golf club head includes a base material, a first plated layer applied to an upper portion of the base material, and a second plated layer applied to an upper portion of the first plated layer; and the fine grooves are formed by cutting grooves on the first plated layer using a laser process and then applying the second plated layer to an upper portion of the first plated layer thus grooved.

According to the foregoing features of the invention, there can be provided a golf club head capable of reliably preventing a backspin rate of a golf ball from varying in rainfall.

Specifically, according to the first aspect of the present invention, there is provided the golf club head formed with a plurality of the fine grooves on its face surface, and when observing the cross-sectional surface perpendicular to the face surface involving the vertical line passing through the center of gravity of the golf club head with the golf club head set at the preset loft and lie angles, the average width of the fine grooves in the cross-sectional surface is 100 μm or less that is narrower than that in the conventional golf club head and besides the average pitch thereof in the cross-sectional surface is 100 μm or less. Hence, a discharge of water can be accelerated by a capillary phenomenon, making it possible to reliably prevent the backspin rate of the golf ball from varying in rainfall.

According to the second aspect of the present invention, the average width of the fine grooves in the cross-sectional surface is 50 μm or less and besides the average pitch thereof in the cross-sectional surface is 50 μm or less. Hence, the fine grooves can be finely and densely formed, making it possible to reliably prevent the backspin rate from varying in rainfall.

According to the third aspect of the present invention, the fine grooves are formed at least in the vicinity of the point of intersection between the vertical line dropped from the center of gravity of the golf club head to the face surface and the face surface. Hence, the fine grooves are formed on a surface contacting with a golf ball, making it possible to reliably prevent the backspin rate from varying in rainfall.

According to the fourth aspect of the present invention, the face surface is provided with a plurality of the score lines, and satisfies the relationships: $n>L/100$ (μm), $0.3(P-H)<L$, $0<d<30$ (μm) and $2<Ra<5$ (μm), wherein, in the cross-sectional surface, n denotes the number of the depressions formed by the fine grooves, L denotes the distance between the protrusions located at both the farthermost ends in the approximately flat surface between adjacent score lines, P denotes the distance between the centers of the score line and its adjacent score line, H denotes the score line width measured by the 30 degree method of measurement, d denotes the average value of the level differences between depressions and the protrusions which are formed by the fine grooves, and Ra denotes the surface roughness in the region formed with the fine grooves. Hence, the discharge of water can be accelerated by a capillary phenomenon, making it possible to reliably prevent the backspin rate from varying in rainfall.

According to the fifth aspect of the present invention, the fine grooves are formed by the processes involving the laser process. Hence, the fine grooves can be easily formed.

According to the sixth aspect of the present invention, the golf club head includes the base material, the first plated layer applied to the upper portion of the base material, and the second plated layer applied to the upper portion of the first plated layer. Then, the fine grooves are formed by cutting grooves on the first plated layer using the laser process and then applying the second plated layer to the upper portion of the first plated layer grooved, making it possible to improve the beauty of the face surface.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE INVENTION

Hereunder, embodiments of golf club heads according to the present invention are described with reference to the accompanying drawings.

First Embodiment

Figure 1:
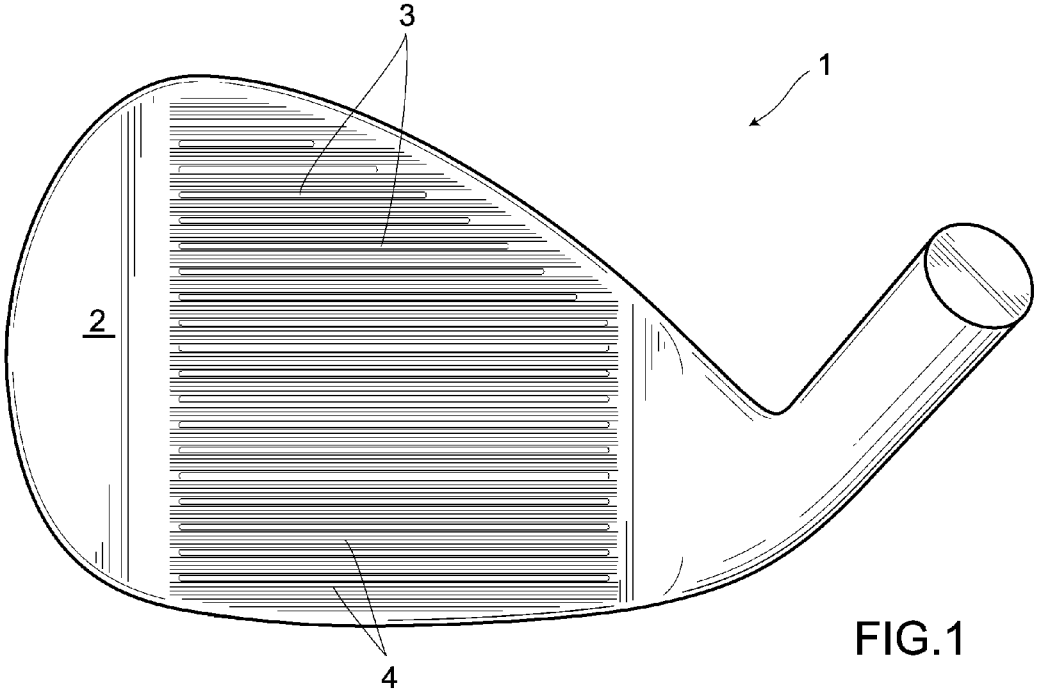
FIG. 1 is a front view showing a golf club head according to a first embodiment of the invention.

In FIG. 1 showing a golf club head in a first embodiment, numeral symbol 1 denotes an iron-type golf club head and a plurality of score lines 3 are formed on a face surface 2 of the golf club head 1. Further, the face surface 2 is formed with a plurality of fine grooves 4 in parallel with the score lines 3. In addition, in the present embodiment, the fine grooves 4 are formed in parallel with the score lines 3. Alternatively, the fine grooves 4 may be formed in a direction intersecting with the score lines 3.

Figure 2:
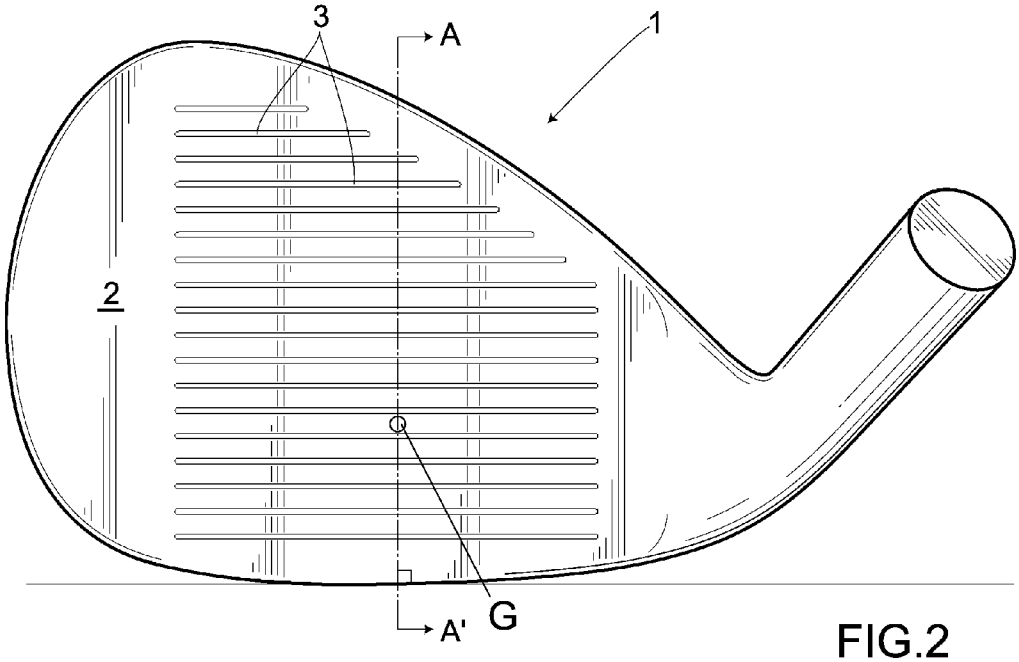
FIG. 2 is a front view showing the golf club head, indicating a position of the center of gravity.

As shown in FIG. 2, a cross-sectional surface perpendicular to the face surface 2 involving a vertical line passing through the center G of gravity of the golf club head 1 is defined as A-A' with the golf club head 1 set at given loft and lie angles preset in a golf club. Hereunder, a description of shapes such as a width of the fine grooves 4 or the like shall be based on this cross-sectional surface A-A'.

Figure 3:
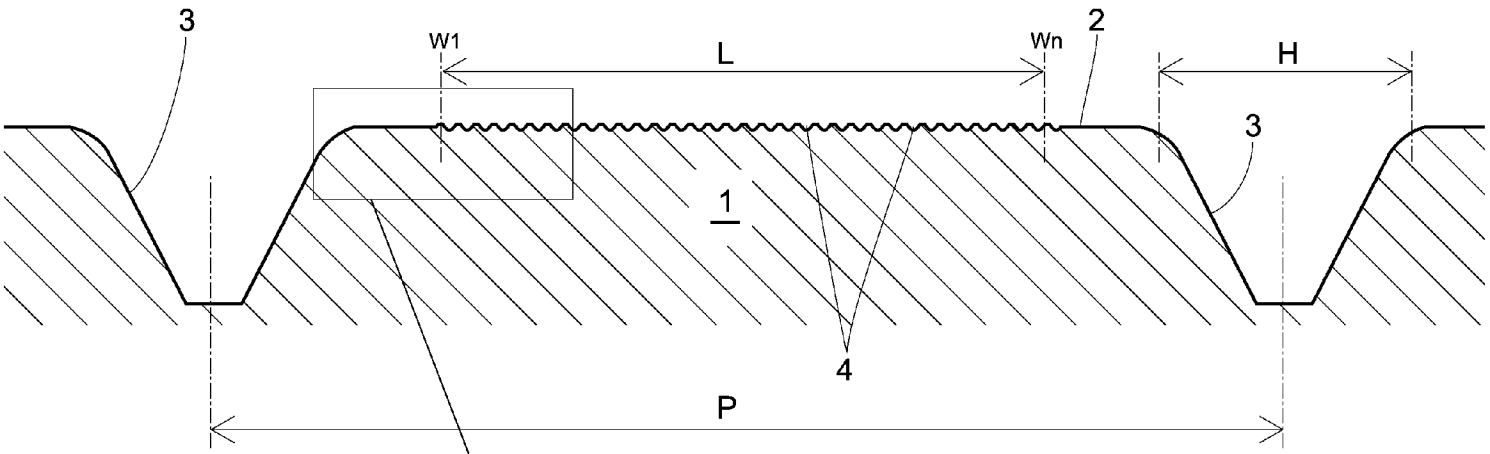
FIG. 3 is a cross-sectional view showing a face surface of the golf club head.
Figure 3A:
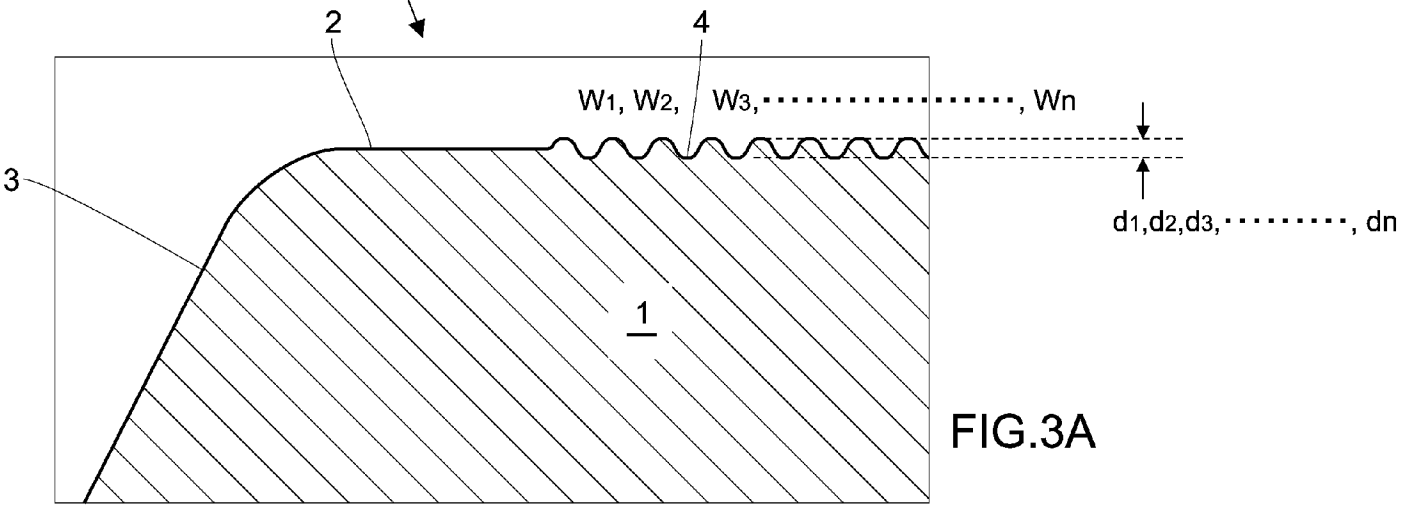
FIG. 3A is an enlarged cross-sectional view thereof according to the first embodiment.

This cross-sectional surface A-A' is shown in FIG. 3. When observing this cross-sectional surface, an average width of the fine grooves 4 in this cross-sectional surface is 100 μm or less and besides an average pitch of the fine grooves 4 in the cross-sectional surface is 100 μm or less. More desirably, both the average width and pitch are 50 μm or less. Depressions and protrusions in the fine grooves are regularly formed. In addition, in the present embodiment, the fine grooves 4 are formed over an entire region provided with the score lines 3. Alternatively, the fine grooves 4 may be formed at least in the vicinity of a point of intersection between a vertical line dropped from the center G of gravity of the golf club head 1 to the face surface 2 and the face surface 2, that is, in a region contacting with a golf ball in hitting the same.

More specifically, when, in the cross-sectional surface shown in FIG. 3, n denotes the number of the protrusions formed by the fine grooves 4, L denotes a distance between the protrusions located at both the farthermost ends in an approximately flat portion between adjacent score lines 3, P denotes a distance between the centers of the score line 3 and its adjacent score line 3, H denotes a score line width measured by the 30 degree method of measurement, d denotes an average value of level differences between the depressions and the protrusions which are formed by the fine grooves 4, and Ra denotes surface roughness in a region formed with the fine grooves 4, the fine grooves 4 are formed so as to satisfy the relationships, $n>L/100$ (μm), $0.3(P-H)<L$, $0<d<30$ (μm), and $2<Ra<5$ (μm). In addition, in FIG. 3, W1, W2, W3, . . . , Wn denote the protrusions formed by the fine grooves 4 in this cross-sectional surface, while in FIG. 3, d1, d2, d3, . . . , do denote level differences between the depressions and the protrusions which are formed by fine grooves 4 in this cross-sectional surface.

The fine grooves 4 are formed by processes involving a laser process. Specifically, first, a base material of the golf club head 1 is polished and then a nickel-plated layer, e.g., 20 μm thick, acting as a first plated layer, is formed on the base material. Then, grooves are cut on the nickel-plated layer by the laser process. Thereafter, a chrome-plated layer, e.g., 5 μm thick, acting as a second layer, is formed on the nickel-plated layer grooved. Through such process, the fine grooves 4 are formed. In addition, in the present embodiment, the laser process is applied to the nickel-plated layer. Alternatively, the laser process may be applied to the base material or the chrome plated layer to thereby form the fine grooves 4. Specifically, in the present embodiment, the fine grooves 4 are formed by the process made up of the order of polishing, nickel plating, forming the depressions and the protrusions by the laser process, and chrome plating. Alternatively, a process made up of the order of polishing, a laser process, nickel plating and the chrome plating, or that made up of the order of polishing, nickel plating, chrome plating, and a laser process may be applied to form the fine grooves 4.

Figure 4:
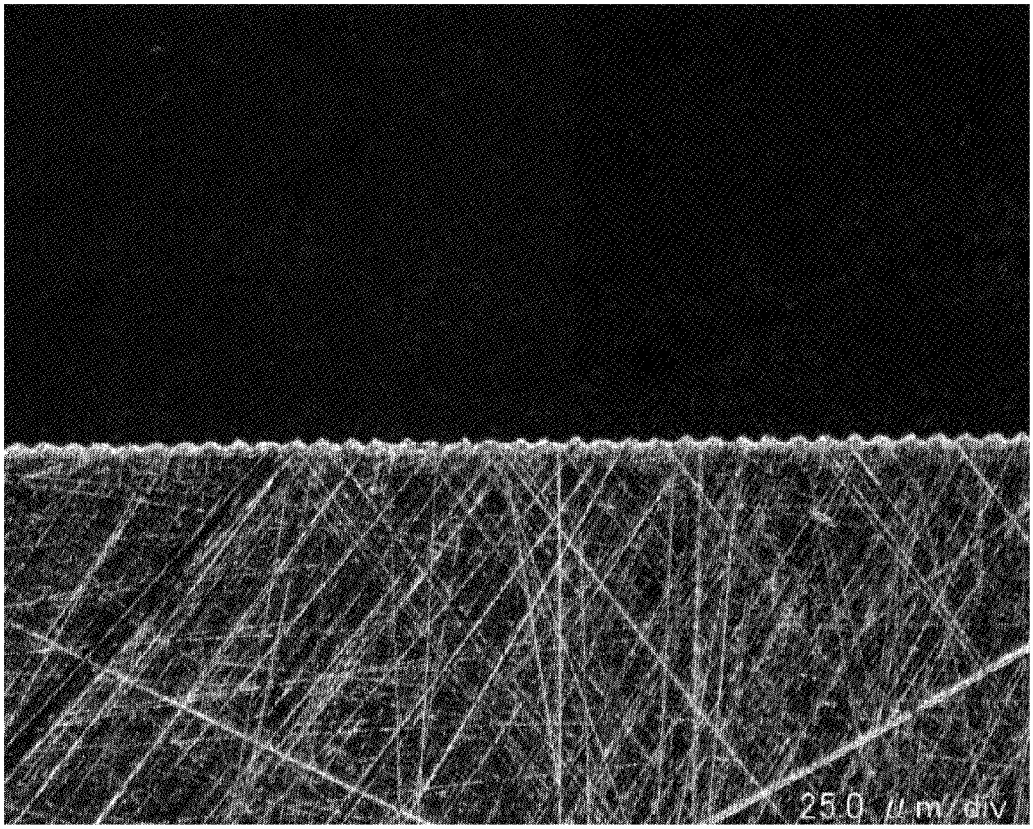
FIG. 4 is a micrograph showing a cross-sectional surface of the face surface in the golf club head according to the first embodiment.

The micrograph of the cross-sectional surface in the face surface 2 of the golf club head 1 actually created in the present embodiment is shown in FIG. 4. The fine grooves 4 have been verified to be finely formed. Further, when having measured the surface roughness in the region formed with the fine grooves 4, it was learnt that Ra=3.76, Rt=21.45. Besides, the width of each of the fine grooves was about 50 μm, the pitch thereof was about 50 μm, and the depth thereof was about 20 μm.

Figure 5:
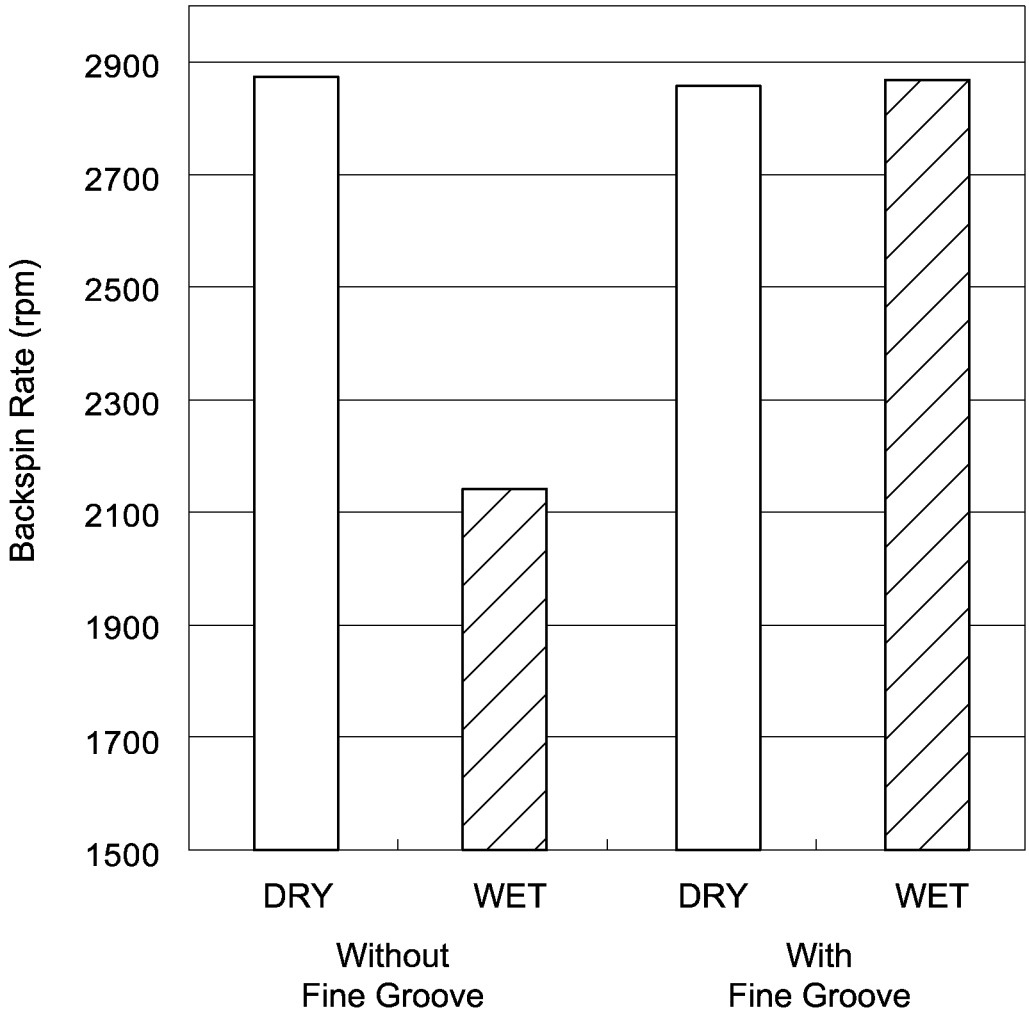
FIG. 5 is a graph indicating a backspin rate of the golf club head according to the first embodiment.

Next, with respect to the golf club head 1 actually created in the present embodiment, a backspin rate of the golf ball was evaluated in hitting the golf ball. There were prepared a golf club with the golf club head 1 formed with the fine grooves 4 in the present embodiment and a golf club with a golf club head 1 not formed with the fine grooves 4 to be used as a comparative example. In addition, a wedge was selected as the type of golf club and all but the presence or absence of the fine grooves 4 were set under the same conditions in both the present embodiment and the comparative examples. The test was performed using a swing robot under a dry condition where the face surface 2 was dry and a wet condition where the face surface 2 was wetted with water, in each golf club. The result is shown in FIG. 5. The golf club not formed with the fine grooves 4 to be used as the comparative example exhibited, under the wet condition, a backspin rate reduced to around half that under the dry condition, while the golf club created in the present embodiment to be formed with the fine grooves 4 exhibited equivalent backspin rates irrespective of the dry and wet conditions. Accordingly, the golf club head 1 in the present embodiment has proved to be able to reliably prevent the backspin rate from varying in rainfall.

Furthermore, the effects of the width and pitch of the fine grooves 4 were studied. A 10-yard approach shot was performed using a swing robot by employing golf clubs each equipped with a head with the width of the score line 3=0.56 mm, the depth thereof=0.35 mm and the pitch thereof=3.5 mm. In addition, golf club heads different from those used to evaluate the above backspin rate were employed. The result is shown in TABLE 1. In the golf club heads, in the present embodiment, with the average width and pitch of 100 μm or less in the fine grooves 4, the reduced backspin rate was small under the wet condition, while in the comparative examples 1 to 3 with the average width of 100 μm in the fine grooves 4 and the average pitch of more than 100 μm therein, the reduced backspin rates were large under the wet condition. Accordingly, it has been proved that the average width and pitch of the fine grooves 4 were desirably 100 μm or less and further were optimally 50 μm or less.

As described above, the golf club head 1 in the present embodiment is formed with the fine grooves 4, and when observing the cross-sectional surface perpendicular to the face surface 2 involving the vertical line passing through the center G of gravity of the golf club head 1 with the golf club head set at the preset loft and lie angles, the average width of the fine grooves in the cross-sectional surface is 100 μm or less and besides the average pitch thereof in the cross-sectional surface is 100 μm or less. Hence, the discharge of water can be accelerated by a capillary phenomenon, making it possible to reliably prevent the backspin rate of the golf ball from varying in rainfall.

Further, the average width of the fine grooves 4 in the cross-sectional surface is 50 μm or less and besides the average pitch thereof in the cross-sectional surface is 50 μm or less. Hence, the fine grooves 4 are finely and densely formed, making it possible to reliably prevent the backspin rate from varying in rainfall.

Furthermore, the fine grooves 4 are formed at least in the vicinity of the point of intersection between the vertical line dropped from the center G of gravity of the golf club head 1 to the face surface 2 and the face surface 2. Hence, the fine grooves are formed on the surface contacting with a golf ball, making it possible to reliably prevent the backspin rate from varying in rainfall.

Moreover, the face surface 2 is provided with a plurality of the score lines 3, and when, in the cross-sectional surface, n denotes the number of the protrusions formed by the fine grooves 4, L denotes a distance between the protrusions located at both the farthermost ends in the approximately flat portion between adjacent score lines 3, P denotes a distance between the centers of the score line 3 and its adjacent score line 3, H denotes a score line width measured by the 30 degree method of measurement, d denotes an average value of the level differences between the depressions and the protrusions which are formed by the fine grooves 4, and Ra denotes the surface roughness in the region formed with the fine grooves 4, the fine grooves 4 are formed so as to satisfy the relationships, $n>L/100$ (μm), $0.3(P-H)<L$, $0<d<30$ (μm), and $2<Ra<5$ (μm). Hence, the discharge of water can be accelerated by a capillary phenomenon, making it possible to reliably prevent the backspin rate from varying in rainfall.

Besides, the fine grooves are formed by the processes involving the laser process. Hence, the fine grooves can be easily formed.

Yet more, the golf club head 1 includes the base material, the nickel-plated layer, acting as the first plated layer, applied to the upper portion of the base material, and the chrome-plated layer, acting as the second plated layer, applied to the upper portion of the nickel-plated layer. The fine grooves 4 are formed by cutting grooves on the nickel-plated layer using the laser process and then applying the chrome-plated layer to the upper portion of the nickel-plated layer grooved, making it possible to improve the beauty of the face surface.

TABLE 1

| | Reference Example | Embodiment 1a | Embodiment 1b | Comparative Example 1 | Comparative Example 2 | Comparative Example 3 |
|---|---|---|---|---|---|---|
| Face Surface Condition | Dry | Wet | Wet | Wet | Wet | Wet |
| Average Width (μm) | No Groove | 50 | 100 | 100 | 100 | 100 |
| Average Pitch (μm) | No Groove | 50 | 100 | 200 | 380 | 500 |
| Ra (μm) | — | 3.76 | 3.32 | 2.84 | 2.18 | 1.82 |
| Rt (μm) | — | 21.45 | 19.1 | 17.2 | 19.65 | 14.66 |
| Backspin rate (rpm) | 2,816 | 2,600 | 2,391 | 1,915 | 1,789 | 1,763 |

Second Embodiment

Figure 6:
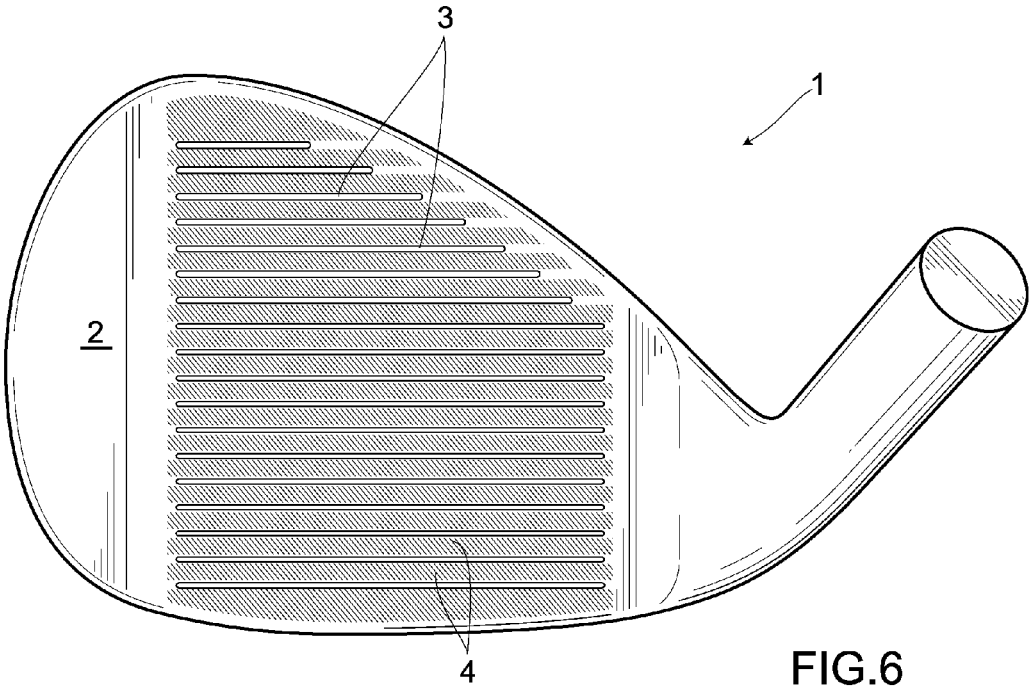
FIG. 6 is a front view showing a golf club head according to a second embodiment of the invention.

As shown in FIG. 6, a golf club head 1 according to a second embodiment is formed with a plurality of fine grooves 4 on its face surface 2 in a direction intersecting with score lines 3. Except for this formation of the fine grooves 4, this golf club head is the same as that in the above First Embodiment.

The above golf club head 1 according to the second embodiment is formed with the fine grooves 4 in the same fashion as is done in the above First Embodiment. When observing a cross-sectional surface perpendicular to the face surface 2 involving a vertical line passing through the center G of gravity of a golf club head 1 with the golf club head 1 set at preset loft and lie angles, an average width of the fine grooves 4 in the cross-sectional surface is 100 μm or less and besides an average pitch thereof in the cross-sectional surface is 100 μm or less. Hence, the discharge of water can be accelerated by a capillary phenomenon, making it possible to reliably prevent a backspin rate of a golf ball from varying in rainfall.

Third Embodiment

Figure 7:
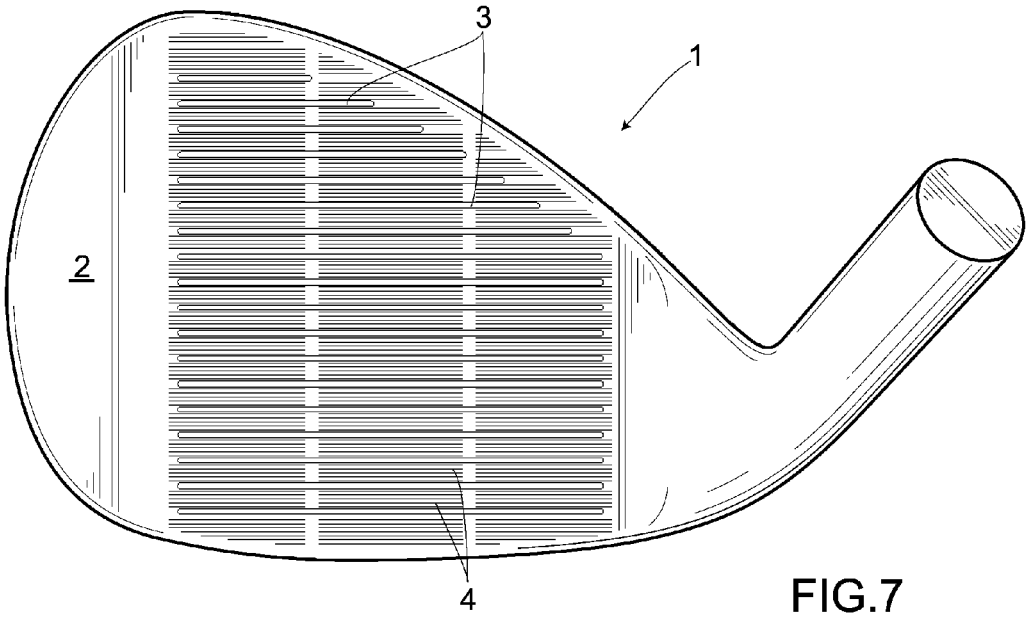
FIG. 7 is a front view showing a golf club head according to a third embodiment of the invention.

As shown in FIG. 7, a golf club head 1 in a third embodiment is formed with double rows of areas formed with no fine groove 4 in a direction perpendicular to score lines 3. These areas divide a region formed with the fine grooves 4 approximately equally into three ones. Except for this formation of the fine grooves 4, the golf club head 1 in the Third Embodiment is the same as that in the above First Embodiment.

The golf club head 1 in the above third embodiment is formed with the fine grooves 4 at least in the vicinity of a point of intersection point between a vertical line dropped from the center G of gravity of the golf club head 1 to a face surface 2 and the face surface 2. Hence, the fine grooves are formed on a surface contacting with a golf ball, making it possible to reliably prevent a backspin rate from varying in rainfall.

Fourth Embodiment

Figure 8:
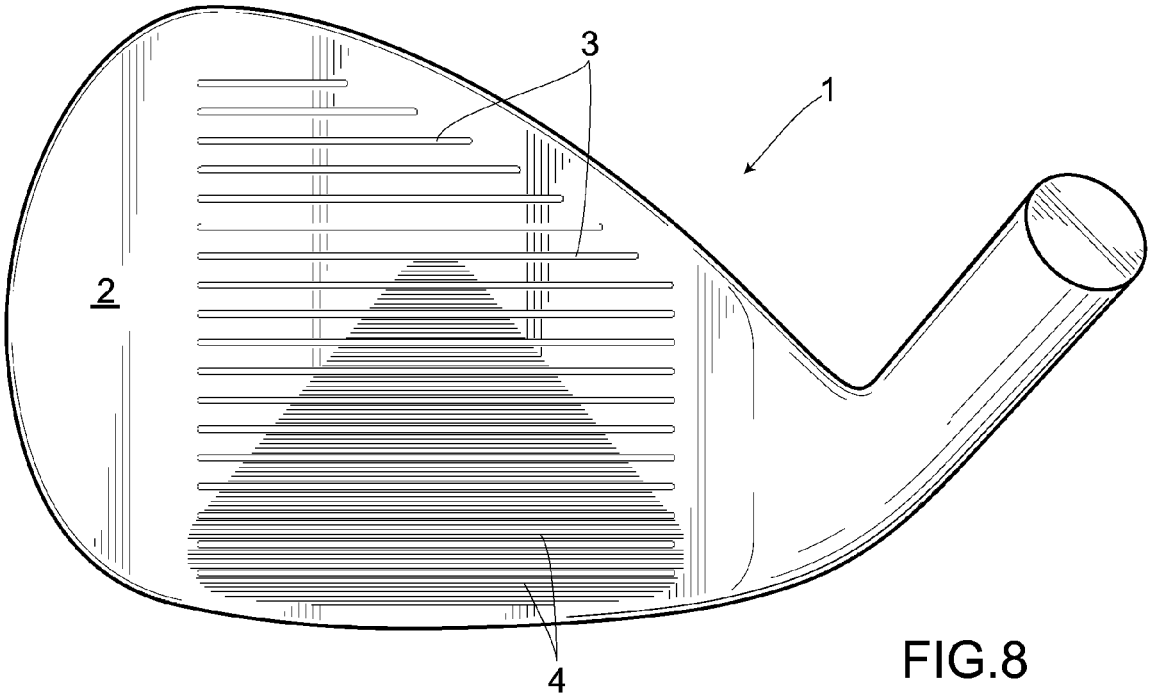
FIG. 8 is a front view showing a golf club head according to a fourth embodiment of the invention.

As shown in FIG. 8, an outer edge of a region provided with fine grooves 4 in a golf club head in a fourth embodiment is formed into an approximately regular triangle. With the exception of this formation of the fine grooves 4, the golf club head 1 in the Fourth Embodiment is the same as that in the above First Embodiment. In addition, a point of intersection between a vertical line dropped from the center G of gravity of the golf club head 1 to a face surface 2 and the face surface 2 is located in the vicinity of the center of the region provided with the fine grooves 4.

The fine grooves 4 of the golf club head in the present fourth embodiment are formed at least in the vicinity of the point of intersection between the vertical line dropped from the center G of gravity of the golf club head 1 to the face surface 2 and the face surface 2. Hence, the fine grooves 4 is formed on a surface contacting with a golf ball, making it possible to reliably prevent a backspin rate of the golf ball from varying in rainfall.

Fifth Embodiment

Figure 9:
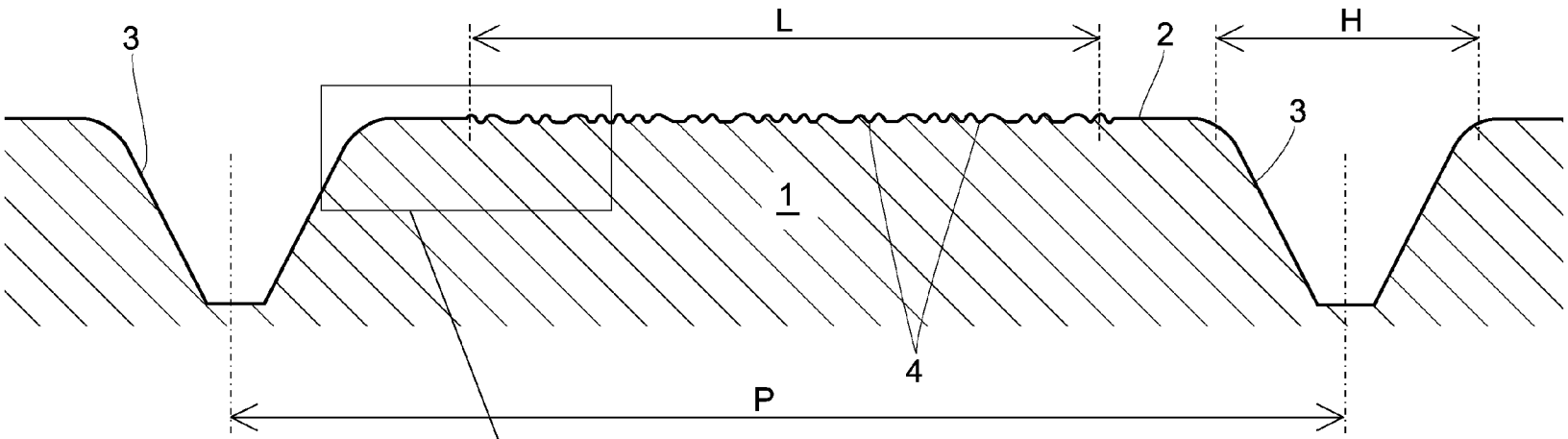
FIG. 9 is a cross-sectional view showing a face surface in a golf club head according to a fifth embodiment of the invention.
Figure 9A:
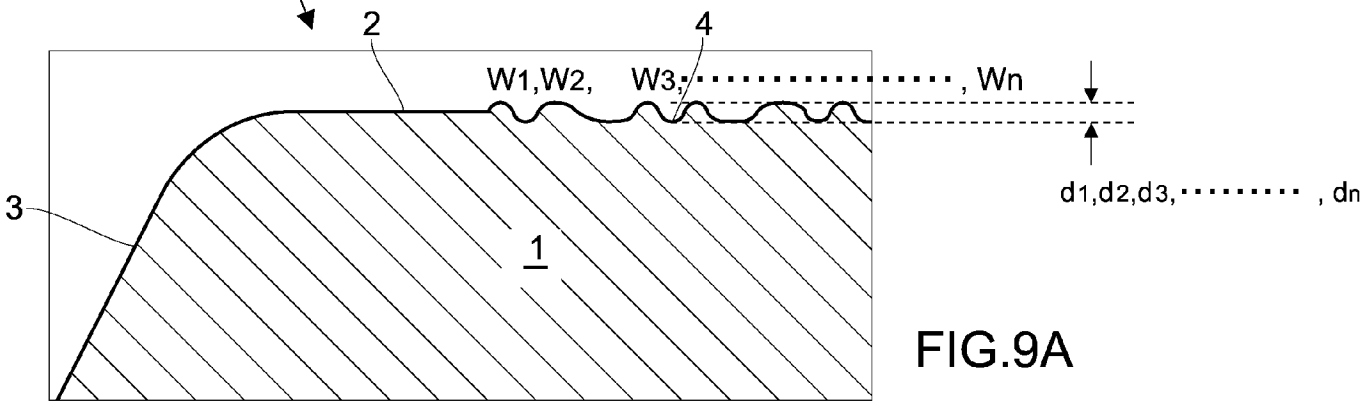
FIG. 9A is an enlarged cross-sectional view thereof.

As shown in FIG. 9, a golf club head in a fifth embodiment is the same as that in the above first embodiment with the exception of the fact that depressions and protrusions of fine grooves 4 are irregularly formed.

The above golf club head 1 in the present fifth embodiment is formed with a plurality of the fine grooves 4 on its face surface 2. When observing a cross-sectional surface perpendicular to the face surface 2 involving a vertical line passing through the center G of gravity of the golf club head 1 with the golf club head 1 set at preset loft and lie angles, an average width of the fine grooves 4 in the cross-sectional surface is 100 μm or less and besides an average pitch thereof in the cross-sectional surface is 100 μm or less. Hence, the discharge of water can be accelerated by a capillary phenomenon, making it possible to reliably prevent a backspin rate of a golf ball from varying in rainfall.

Sixth Embodiment

A golf club head 1 in a sixth embodiment is made from a titanium alloy and is a wood-type one.

Fine grooves are formed by processes involving a laser process. The titanium alloy, however, is employed for this golf club head and therefore the fine grooves are formed only by cutting grooves using the laser process after polishing a base material.

Figure 10:
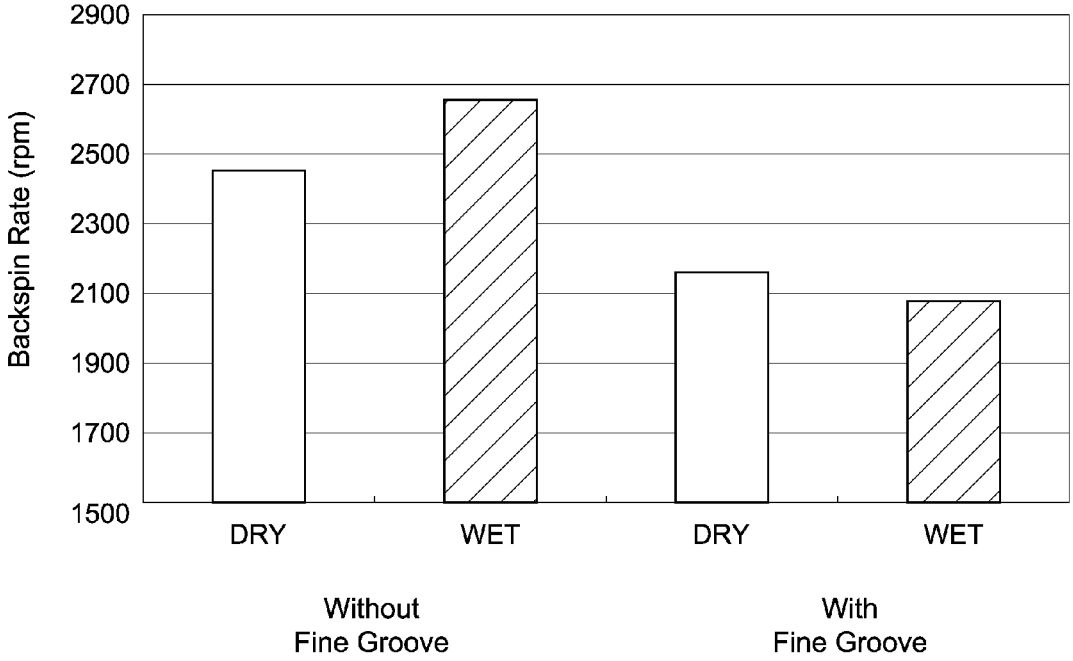
FIG. 10 is a graph indicating a backspin rate of a golf club head according to a sixth embodiment of the invention.

With respect to the golf club head in the present sixth embodiment actually made, a backspin rate was evaluated in hitting a golf ball. There were prepared a golf club with a golf club head formed with the fine grooves in the present Sixth Embodiment and a golf club with a golf club head not formed with the fine grooves to be used as a comparative example. In addition, as a type of golf club, a driver with a loft angle of 9.5 degrees was employed, and all but the presence or absence of the fine grooves were set under the same condition both in the present embodiment and in the comparative example. In addition, surface roughness Ra, Rt in a region formed with the fine grooves were Ra=3.6, Rt=21.8, and the width, pitch and depth of the fine grooves were about 50 μm, about 50 μm, and about 20 μm, respectively. The backspin rate was evaluated using a swing robot under a dry condition where the face surface was dry and under a wet condition where the face surface was wetted with water. The result is shown in FIG. 10. The golf club with a head not formed with the fine grooves to be used as the comparative example exhibited a largely increased backspin rate under the wet condition as compared to that under the dry condition, while the golf club head formed with the fine grooves in the present Sixth Embodiment exhibited equivalent backspin rates irrespective of the dry and wet conditions. Accordingly, the golf club head in the present embodiment has proved to be able to prevent the backspin rate of a golf ball from varying in rainfall.

In addition, the present invention is not limited to the above embodiments and various modifications are possible. Some wood-type golf club heads formed with no score lines are known, e.g., and the present invention may be applied thereto.

What is claimed is:

1. A golf club head comprising:

a plurality of fine grooves formed on a face surface thereof, said fine grooves having an average width of 100 μm or less in a cross-sectional surface perpendicular to said face surface and an average pitch of 100 μm or less in the cross-sectional surface, when the cross-sectional surface perpendicular to said face surface involving a vertical line passing through the center of gravity of said golf club head is observed, with said golf club head set at preset loft and lie angles.

2. The golf club head according to claim 1, wherein the average width of said fine grooves in said cross-sectional surface is 50 μm or less and the average pitch of said fine grooves in said cross-sectional surface is 50 μm or less.

3. The golf club head according to claim 2, wherein said fine grooves are formed at least in the vicinity of a point of intersection between said face surface and a vertical line dropped from the center of gravity of said golf club head to said face surface.

4. The golf club head according to claim 3, wherein said face surface includes a plurality of score lines, and satisfies the following relationships:

$$n>L/100\ (\mu m),$$

$$0.3(P-H)<L,$$

$$0<d<30\ (\mu m),\ \text{and}$$

$$2<Ra<5\ (\mu m)$$

wherein, in said cross-sectional surface, n denotes the number of protrusions formed by said fine grooves, L denotes a distance between the protrusions located at both the farthermost ends in an approximately flat portion between adjacent score lines of said score lines, P denotes a distance between centers of said adjacent score lines, H denotes a score line width measured by the 30 degree method of measurement, d denotes an average value of level differences between depressions and the protrusions which are formed by said fine grooves, and Ra denotes surface roughness in a region formed with said fine grooves.

5. The golf club head according to claim 4, wherein said fine grooves are formed by processes involving a laser process.

6. The golf club head according to claim 5, comprising:
a base material;
a first plated layer applied to an upper portion of said base material, and
a second plated layer applied to an upper portion of said first plated layer,
wherein said fine grooves are formed by cutting grooves on said first plated layer using a laser process and then applying said second plated layer to an upper portion of said first plated layer thus grooved.

7. The golf club head according to claim 3, wherein said fine grooves are formed by processes involving a laser process.

8. The golf club head according to claim 7, comprising:
a base material;
a first plated layer applied to an upper portion of said base material, and
a second plated layer applied to an upper portion of said first plated layer,
wherein said fine grooves are formed by cutting grooves on said first plated layer using a laser process and then applying said second plated layer to an upper portion of said first plated layer thus grooved.

9. The golf club head according to claim 2, wherein said fine grooves are formed by processes involving a laser process.

10. The golf club head according to claim 9, comprising:
a base material;
a first plated layer applied to an upper portion of said base material; and
a second plated layer applied to an upper portion of said first plated layer,
wherein said fine grooves are formed by cutting grooves on said first plated layer using a laser process and then applying said second plated layer to an upper portion of said first plated layer thus grooved.

11. The golf club head according to claim 1, wherein said fine grooves are formed at least in the vicinity of a point of intersection between said face surface and a vertical line dropped from the center of gravity of said golf club head to said face surface.

12. The golf club head according to claim 11, wherein said face surface includes a plurality of score lines, and satisfies the following relationships:

$$n>L/100\ (\mu m),$$

$$0.3(P-H)<L,$$

$$0<d<30\ (\mu m),\ \text{and}$$

$$2<Ra<5\ (\mu m)$$

wherein, in said cross-sectional surface, n denotes the number of protrusions formed by said fine grooves, L denotes a distance between the protrusions located at both the farthermost ends in an approximately flat portion between adjacent score lines of said score lines, P denotes a distance between centers of said adjacent score lines, H denotes a score line width measured by the 30 degree method of measurement, d denotes an average value of level differences between depressions and the protrusions which are formed by said fine grooves, and Ra denotes surface roughness in a region formed with said fine grooves.

13. The golf club head according to claim 12, wherein said fine grooves are formed by processes involving a laser process.

14. The golf club head according to claim 13, comprising:
a base material;
a first plated layer applied to an upper portion of said base material, and
a second plated layer applied to an upper portion of said first plated layer,
wherein said fine grooves are formed by cutting grooves on said first plated layer using a laser process and then applying said second plated layer to an upper portion of said first plated layer thus grooved.

15. The golf club head according to claim 11, wherein said fine grooves are formed by processes involving a laser process.

16. The golf club head according to claim 15, comprising:
a base material;
a first plated layer applied to an upper portion of said base material, and
a second plated layer applied to an upper portion of said first plated layer,
wherein said fine grooves are formed by cutting grooves on said first plated layer using a laser process and then applying said second plated layer to an upper portion of said first plated layer thus grooved.

17. The golf club head according to claim 1, wherein said fine grooves are formed by processes involving a laser process.

18. The golf club head according to claim 17, comprising:
a base material;
a first plated layer applied to an upper portion of said base material, and
a second plated layer applied to an upper portion of said first plated layer,
wherein said fine grooves are formed by cutting grooves on said first plated layer using a laser process and then applying said second plated layer to an upper portion of said first plated layer thus grooved.

* * * * *